US007300313B1

(12) United States Patent
Whiteman, Jr. et al.

(10) Patent No.: US 7,300,313 B1
(45) Date of Patent: Nov. 27, 2007

(54) ELECTRICAL CONNECTOR HAVING STAGGERED CONTACTS

(75) Inventors: Robert Neil Whiteman, Jr., Middletown, PA (US); Christopher David Ritter, Hummelstown, PA (US)

(73) Assignee: Tyco Electronics Corporation, Middletown, PA (US)

( * ) Notice: Subject to any disclaimer, the term of this patent is extended or adjusted under 35 U.S.C. 154(b) by 0 days.

(21) Appl. No.: 11/445,524

(22) Filed: Jun. 2, 2006

(51) Int. Cl.
*H01R 13/648* (2006.01)

(52) U.S. Cl. ..... 439/608; 439/358; 439/924.1

(58) Field of Classification Search ..... 439/924.1, 439/680, 358, 357, 296, 752, 378, 608
See application file for complete search history.

(56) References Cited

U.S. PATENT DOCUMENTS 4,867,690 A * 9/1989 Thumma ..... 439/79
5,176,528 A * 1/1993 Fry et al. ..... 439/181
5,197,893 A * 3/1993 Morlion et al. ..... 439/101
5,342,221 A * 8/1994 Peterson ..... 439/677
5,586,915 A 12/1996 Baker et al.
5,591,035 A 1/1997 Burkholder et al.
5,595,509 A 1/1997 Fry et al.
5,885,088 A * 3/1999 Brennan et al. ..... 439/680
6,217,364 B1 4/2001 Miskin et al.

* cited by examiner

*Primary Examiner*—Javaid H. Nasri

(57) ABSTRACT

A connector includes a housing with a plurality of contact cavities arranged in a matrix having M columns and N rows of contact cavities. Each of the contact cavities extend between a contact loading side and a mating side of the housing. Contacts are received within respective ones of the contact cavities, wherein a first group of the contacts are held within the contact cavities at a first depth with respect to the contact loading side and a second group of the contacts are held within the contact cavities at a different second depth with respect to the contact loading side.

20 Claims, 3 Drawing Sheets

ELECTRICAL CONNECTOR HAVING STAGGERED CONTACTS

BACKGROUND OF THE INVENTION

This invention relates generally to electrical connectors, and more specifically, to electrical connectors holding contacts at staggered depths within the connector housing.

Conventional cable-to-cable or cable-to-board connectors typically include a receptacle connector and a plug connector. Contacts of the connectors are interconnected to one another during mating of the connectors. However, known connectors suffer from problems associated with the mating of the connectors. For example, the connectors typically require alignment and proper orientation of the receptacle connector and the plug connector for mating. Sometimes visibility or accessibility are limited, which makes it difficult for a user to align and orient the connectors.

Furthermore, more and more contacts are being housed in each connector to accommodate higher power demands through the connectors. As a result, the connectors are more difficult to mate with one another because the mating force required to fully mate the connectors is increased. Improper mating of the connectors may lead to a partial or complete failure of the system operated by the connectors.

To overcome these and other mating problems, at least some known connectors provide thumb screws on the receptacle connector that may be secured to the plug connector or chassis surrounding the plug connector. By tightening the thumb screws, the connectors become fully mated, and removal of the receptacle connector from the plug connector is restricted. However, other problems are associated with the use of such known thumb screws. Particularly, tightening and un-tightening the thumb screws is difficult and sometimes uncomfortable for the user. Additionally, tightening and un-tightening the thumb screws is time consuming.

A need exists for connectors that may be mated in a convenient and efficient manner, and with less mating force and less stress on the contacts.

BRIEF DESCRIPTION OF THE INVENTION

In one aspect, a connector is provided including a housing with a plurality of contact cavities arranged in a matrix having M columns and N rows of contact cavities. Each of the contact cavities extend between a contact loading side and a mating side of the housing. Contacts are received within respective ones of the contact cavities, wherein a first group of the contacts are held within the contact cavities at a first depth with respect to the contact loading side and a second group of the contacts are held within the contact cavities at a different second depth with respect to the contact loading side.

Optionally, the first group of contacts may be located in odd numbered columns of the contact cavities and the second group of contacts may be located in the even numbered columns of the contact cavities. The contacts in the first group may be alternately staggered with respect to the immediately adjacent contacts in the second group within at least one of a common row and a common column. Optionally, each contact has a mating end, and the mating end of each contact in the first group is arranged along a first plane, and the mating end of each contact in the second group is arranged along a second plane parallel to the first plane and parallel to the mating side of the housing. Optionally, the connector may comprise one of a cable connector configured to be joined to a cable and a panel connector configured to be joined to a panel. The connector may comprise one of a plug and a receptacle.

In another aspect, a connector assembly is provided that includes a receptacle connector having a receptacle housing with a plurality of receptacle contact cavities arranged in a matrix and extending between a contact loading side and a mating side of the receptacle housing. The receptacle connector further has receptacle contacts held within respective ones of the receptacle contact cavities. The connector assembly further includes a plug connector having a plug housing with a plurality of plug contact cavities arranged in a matrix that complements the matrix of receptacle contact cavities. Each of the plug contact cavities extend between a contact loading side and a mating side of the plug housing. The plug connector includes plug contacts received within respective ones of the plug contact cavities, wherein a first group of the plug contacts are held within the plug contact cavities at a first depth with respect to the contact loading side of the plug connector and a second group of the plug contacts are held within the plug contact cavities at a different second depth with respect to the contact loading side of the plug connector. The receptacle contacts engage the plug contacts arranged at the first depth prior to engaging the plug contacts at the second depth during mating of the receptacle connector with the plug connector.

DETAILED DESCRIPTION OF THE INVENTION

Figure 1:
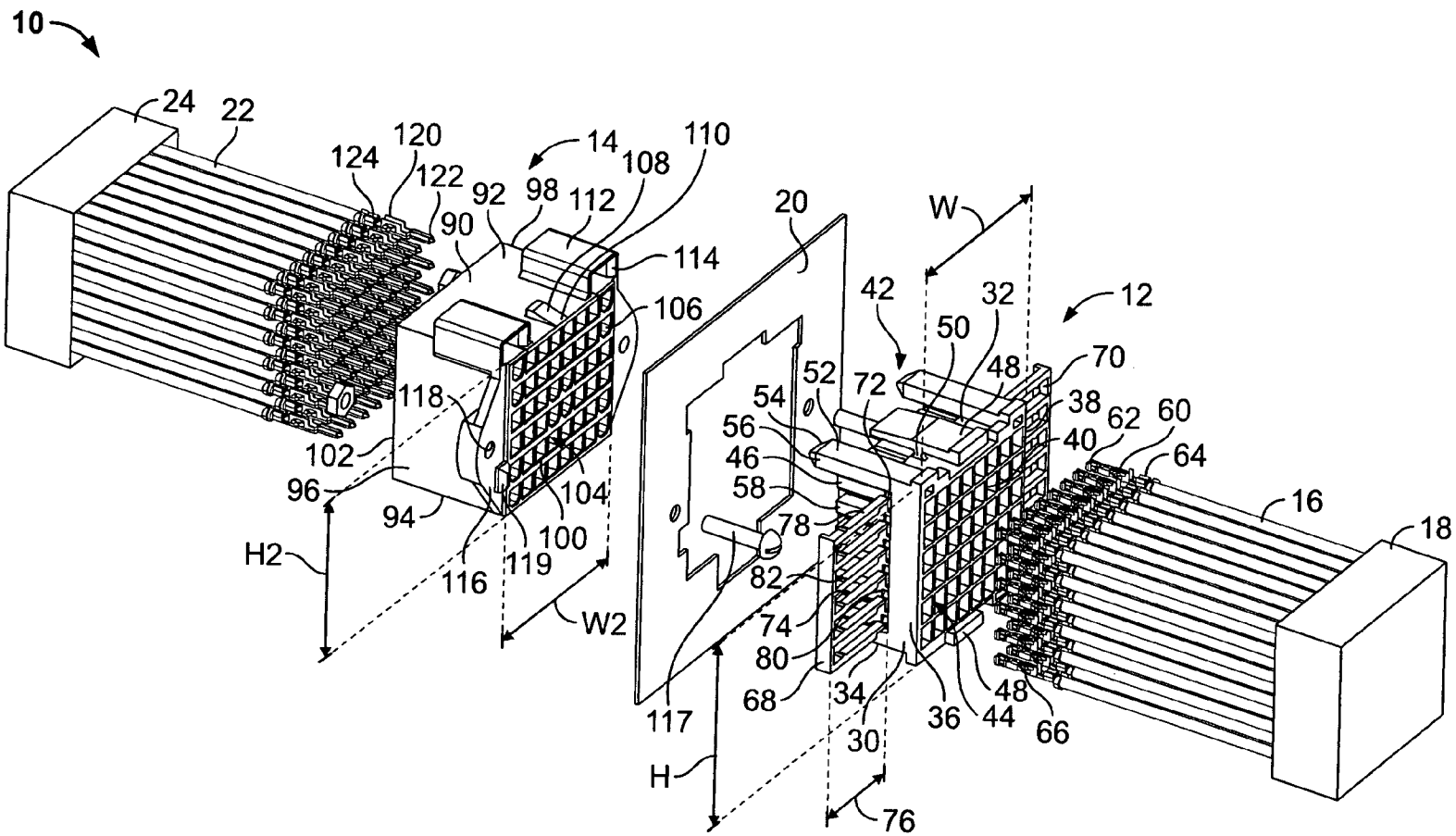
FIG. 1 illustrates an exploded perspective view of a connector assembly formed in accordance with an exemplary embodiment of the present invention.

FIG. 1 illustrates an exploded perspective view of a connector assembly 10 having a receptacle connector 12 and a plug connector 14. In the illustrated embodiment, the receptacle connector 12 is a cable connector for terminating a plurality of wires 16 of a cable 18. The cable 18 may be transmitting power, data, or both. In the illustrated embodiment, the plug connector 14 is a panel connector that may be mounted to a panel, a backplane, or the like, generally identified 20. Optionally, the plug connector 14 may be terminated to wires 22 of another cable 24. As such, the connector assembly 10 generally defines a cable-to-cable connector assembly. Alternatively, the plug connector 14 may be terminated to an integrated circuit or circuit board (not shown).

As illustrated in FIG. 1, the receptacle connector 12 includes an insulative housing 30 that is generally box shaped and includes a top 32, a bottom 34, a first side 36, a second side 38, a rear 40 and a front 42. The rear 40 defines a contact loading end, and the front 42 defines a mating end of the receptacle connector 12. The top 32 and bottom 34 define a width W of the housing 30, and the first side 36 and second side 38 define a height H of the housing 30.

The housing 30 includes a plurality of receptacle contact cavities 44 extending from the rear 40 to the front 42. The receptacle contact cavities 44 are arranged in a matrix having M columns of contact cavities 44 and N rows of contact cavities 44. In the illustrated embodiment, the matrix includes eight columns of contact cavities 44 and six rows of contact cavities 44. However, it is realized that the receptacle connector 12 may include a greater or fewer number of columns or rows of contact cavities 44. The contact cavities 44 are generally hollow rectangular openings. Optionally, at least some of the contact cavities 44 may include chamfered surfaces 46 at the mating end or front 42 of the housing 30. The contact cavities 44 may be tapered from rear 40 to front 42 or from front 42 to rear 40.

The receptacle connector 12 includes locking members 48 extending from each of the top 32 and bottom 34 of the housing 30. The locking members 48 lockably engage the plug connector 14 when the receptacle connector 12 is mated to the plug connector 14. In the exemplary embodiment, the locking members 48 represent latches that may be pivoted to release the locking members 48 from the plug connector 14. Optionally, the locking members 48 may be generally T-shaped, such that each locking member 48 pivots about a base 50 of the T-shaped member.

The receptacle connector 12 includes blind mating members 52 extending from the top 32 of the housing 30. Optionally, the blind mating members 52 may be used as keying features during mating of the receptacle connector 12 with the plug connector 14. The blind mating members 52 also orient and align contact silos 58 that surround the contact cavities 44 at the front 42 with respect to the plug connector 14 prior to mating. In the exemplary embodiment, the blind mating members 52 represent beams having a generally rectangular shape that extend beyond the front 42 of the housing 30 such that the blind mating members 52 engage the plug connector 14 prior to the contact cavities 44 engaging the plug connector 14. Optionally, the blind mating members 52 may include chamfered surfaces 54 at a distal end 56 of the blind mating members 52.

As described above, the cable 18 and the plurality of wires 16 are terminated to the receptacle connector 12. In the exemplary embodiment, the receptacle connector 12 includes a plurality of receptacle contacts 60 that are received within the contact cavities 44 during assembly of the receptacle connector 12. Each contact 60 includes a mating end 62 and a wire terminating end 64. An exposed portion of one of the wires 16 is terminated to the wire terminating end 64 by a crimping process. Alternatively, another terminating process, such as a soldering process or an insulation displacement process may be used. In an exemplary embodiment, the contact 60 represents a crimp-snap style contact that is attached to a wire via a crimping process and snappably retained within the contact cavities 44, as explained in further detail below.

Once terminated, the contact 60 is loaded into the contact loading end or rear 40 of the housing 30 into a corresponding contact cavity 44. Alternatively, the wire 16 may be terminated to the contact 60 after the contact 60 is loaded into the contact cavity 44. Optionally, the contact 60 may include a barb or lance 66 extending outwardly that engages a portion of the receptacle connector 12 to resist removal of the contact 60 from the contact cavity 44. The lance 66 may engage a portion of the contact cavity 44, such as a pit or shoulder (not shown) within the contact cavity 44, to resist removal of the contact 60 from the contact cavity 44. Optionally, a portion of the contact 60 is configured to engage a positive locking member 68 to resist removal from the contact cavity 44. In an exemplary embodiment, the contacts 60 are substantially aligned within the contact cavities 44 such that the mating ends 62 of the contacts are arranged along a common plane. Alternatively, the contacts 60 may be staggered within the contact cavities 44 such that the mating ends 62 of the contacts are arranged in more than one plane.

In the illustrated embodiment, the receptacle connector 12 includes a first positive locking member, which is identified by reference numeral 68, and a second positive locking member 70. The first positive locking member 68 may be loaded into openings 72 in the first side 36 of the housing 30. Similarly, the second positive locking member 70 may be loaded into similar openings (not shown) in the second side 38 of the housing 30. Optionally, the openings 72 in the first side 36 are substantially aligned with the openings in the second side 38. Alternatively, the openings 72 in the first side 36 may be off-set with respect to the openings in the second side 38.

Each of the positive locking members 68 and 70 includes a plurality of arms 74 that extend for a length 76. Optionally, the number of arms 74 equals the number of rows N of contact cavities 44. Alternatively, the number of arms 74 may be less than the number of rows N of contact cavities 44. In an exemplary embodiment, the lengths 76 of the arms 74 are the same for each of the positive locking members 68 and 70. Alternatively, the lengths 76 are different. In an exemplary embodiment, the lengths 76 are slightly longer than half of the width W of the housing 30. Additionally, the arms 74 of each of the positive locking members 68 and 70 include overlap sections 78 at the distal ends 80 thereof. The overlap sections 78 of the first positive locking member 68 overlap the overlap sections 78 of the second positive locking member 70 when the positive locking members 68 and 70 are installed within the housing 30. The strength and rigidity of each of the positive locking members 68 and 70 may be increased due to the overlap. Each of the arms 74 may also include ribs 82 extending from the arms 74. The ribs 82 engage the housing 30 when the positive locking members 68 and 70 are installed within the housing 30 to provide a friction fit and resist removal of the positive locking member 68 or 70 from the housing 30.

When installed, the positive locking members 68 and 70 are exposed to the contact cavities 44. For example, during assembly of the receptacle connector 12, the contacts 60 are loaded into the contact cavities 44, and then the positive locking members 68 and 70 are loaded into the housing 30 from the first side 36 and the second side 38, respectively. The lances 66 of the contacts 60 engage the arms 74 of the positive locking members 68 and 70 to resist removal of the contacts 60 from the contact cavities 44.

As illustrated in FIG. 1, the plug connector 14 includes an insulative housing 90 that is generally box shaped and includes a top 92, a bottom 94, a first side 96, a second side 98, a front 100 and a rear 102. The front 100 defines a mating end, and the rear 102 defines a contact loading end of the plug connector 14. The top 92 and bottom 94 define a width W2 of the housing 90, and the first side 96 and second side 98 define a height H2 of the housing 90.

The housing 90 includes a plurality of plug contact cavities 104 extending from the front 100 to the rear 102. The plug contact cavities 104 are arranged in a matrix having M columns of contact cavities 104 and N rows of contact cavities 104 that correspond to the M columns of contact cavities 44 and N rows of contact cavities 44 of the receptacle connector 12. The contact cavities 104 are generally hollow rectangular openings. Optionally, at least some of the contact cavities 104 may include chamfered surfaces 106 at the mating end or front 100 of the housing 90. The positioning of the contact cavities 104 having chamfered surfaces 106 may be used for polarizing or keying the mating of the plug connector 14 and the receptacle connector 12. The contact cavities 104 may be tapered from front 100 to rear 102 or from rear 102 to front 100.

The plug connector 14 includes locking members 108 extending from each of the top 92 and bottom 94 of the housing 90. The locking members 108 lockably engage the locking members 48 of the receptacle connector 12 when the receptacle connector 12 is mated to the plug connector 14. In the exemplary embodiment, the locking members 108 represent catches that extend from the top 92 and bottom 94. Optionally, the locking members 108 may be generally wedge-shaped having a ramped surface 110 that extends from the front 100 of the housing 90.

The plug connector 14 includes blind mating members 112 extending from the top 92 of the housing 90. The blind mating members 112 polarize the receptacle connector 12 with the plug connector 14 during mating. The blind mating members 112 also orient and align the contact cavities 104 with the contact cavities 44 of the receptacle connector 12 prior to mating. In the exemplary embodiment, the blind mating members 112 represent openings having a generally rectangular shape that corresponds or complements the shape of the blind mating members 52 of the receptacle connector 12. Optionally, the blind mating members 112 may include chamfered surfaces 114 proximate the front 100.

The plug connector 14 includes mounting tabs 116 extending from each of the first and second sides 96 and 98, respectively. The mounting tabs 116 each include mounting holes 118 for receiving fasteners 117 for mounting the plug connector 14 to the panel 20. Optionally, the mounting tabs 116 may be slightly recessed from the front 100 to accommodate for the panel 20. As such, the panel is flush with the front 100 when the plug connector 14 is mounted to the panel 20. Optionally, the plug connector 14 may include a blind mating feature 119 extending from one of the mounting tabs 116. The blind mating feature 119 fits into a corresponding opening in the panel 20 to ensure proper alignment and positioning of the plug connector 14 with respect to the panel 20.

As described above, the cable 24 and the plurality of wires 22 are terminated to the plug connector 14. In the exemplary embodiment, the plug connector 14 includes a plurality of plug contacts 120 that are received within contact cavities 104 during assembly of the plug connector 14. Each contact 120 includes a mating end 122 and a wire terminating end 124. An exposed portion of one of the wires 16 is terminated to the wire terminating end 124 by a crimping process. Alternatively, another terminating process, such as a soldering process may be used. Once terminated, the contact 120 is loaded into the contact loading end or rear 102 of the housing 90 into a corresponding contact cavity 104. Alternatively, the wire 22 may be terminated to the contact 120 after the contact 120 is loaded into the contact cavity 104. In an exemplary embodiment, the contact 120 represents a crimp-snap style contact that is attached to a wire via a crimping process and snappably retained within the contact cavities 104, as explained in further detail below.

Optionally, the depth of placement of each contact 120 within the contact cavities 104 may be controlled such that the mating ends 122 of a first set of contacts 120 may be placed at a first depth with respect to the mating end or front 100 of the housing 90, and the mating ends 122 of a second set of contacts 120 may be placed at a second depth with respect to the mating end or front 100 of the housing 90. As such, the mating ends 122 of the first set of contacts 120 may all be aligned along a first plane that is parallel to the front 100 of the housing 90 and the mating ends 122 of the second set of contacts 120 may all be aligned along a second plane that is also parallel to the front 100 of the housing 90. The first plane may be off-set toward, or positioned relatively closer to, the front 100 with respect to the second plane. As a result, during mating of the receptacle connector 12 and the plug connector 14, the contacts 60 of the receptacle connector 12 interface with the first set of contacts 120 prior to interfacing with the second set of contacts 120. The mating forces are thus reduced. Optionally, the contacts 120 in the odd numbered columns are received within the contact cavities 104 to the first depth and the contacts 120 in the even numbered columns are received within the contact cavities 104 to the second depth. Alternatively, the contacts 120 in the odd numbered rows are received within the contact cavities 104 to the first depth and the contacts 120 in the even numbered rows are received within the contact cavities 104 to the second depth. In other alternative embodiments, the pattern of contacts 120 placed at the first depth is randomized or clustered, and is not defined by column or row.

Figure 2:
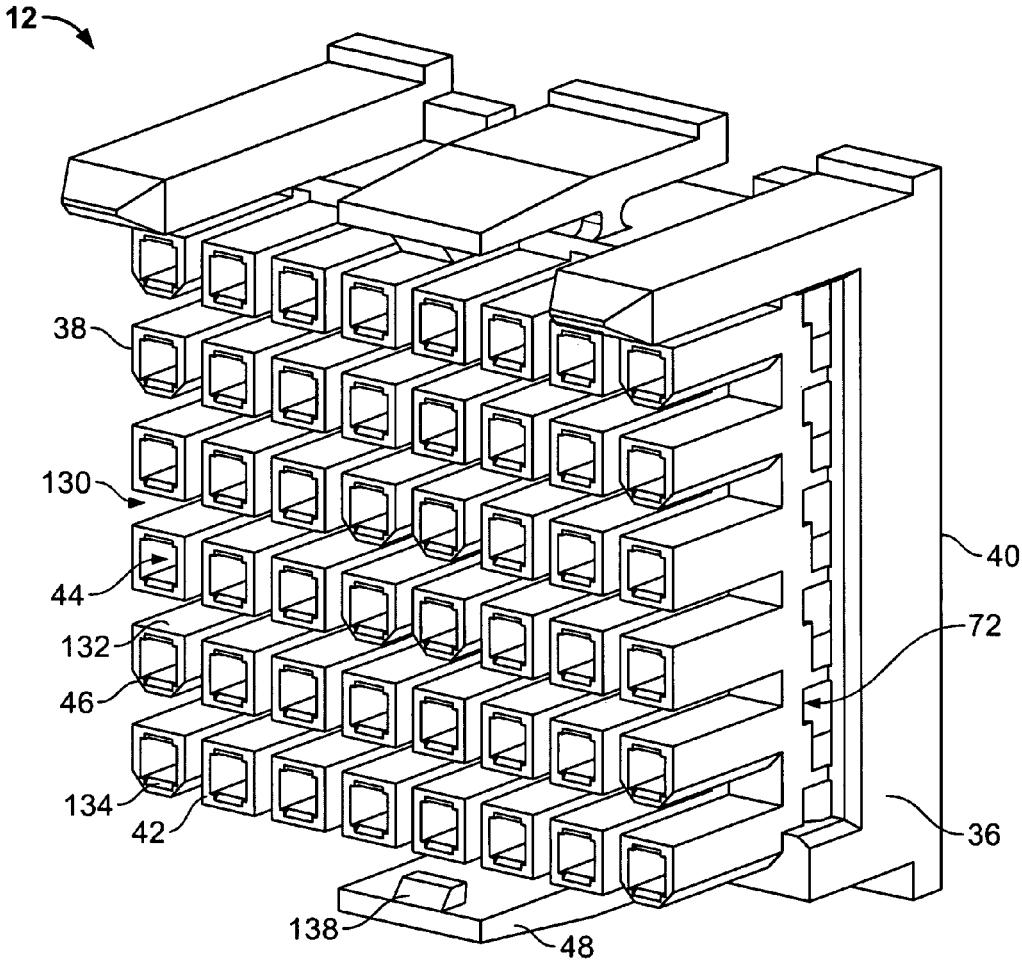
FIG. 2 is a front perspective view of a receptacle connector of the connector assembly shown in FIG. 1.

FIG. 2 is a front perspective view of the receptacle connector 12. As illustrated in FIG. 2, slots or gaps 130 are positioned between each row of the contact cavities 44 and each column of the contact cavities 44. The slots 130 receive portions of the housing 90 (shown in FIG. 1) of the plug connector 14 (shown in FIG. 1) during mating of the receptacle connector 12 with the plug connector 14. The slots 130 define the individual contact silos 58 that surround the contact cavities 44. As indicated above, at least some of the contact silos 58 include chamfered surfaces 46. Optionally, each of the contact silos 58 may include ramped surfaces 134 that extend from the front 42 into the contact cavities 44. The ramped surfaces 134 ease mating by directing the plug contacts 120 (shown in FIG. 1) into the contact cavities 44.

As further illustrated in FIG. 2, upstream of the contact silos 58, generally toward the rear 40, are the openings 72 in the first side 36 for the positive locking member 68 (shown in FIG. 1). In the exemplary embodiment, similar openings are provided on the second side 38 for the second positive locking member 70. Also illustrated in FIG. 2 is a tooth 138 extending generally inward from each locking member 48. The tooth 138 is configured to engage the corresponding locking member 108 (shown in FIG. 1) of the plug assembly 14.

Figure 3:
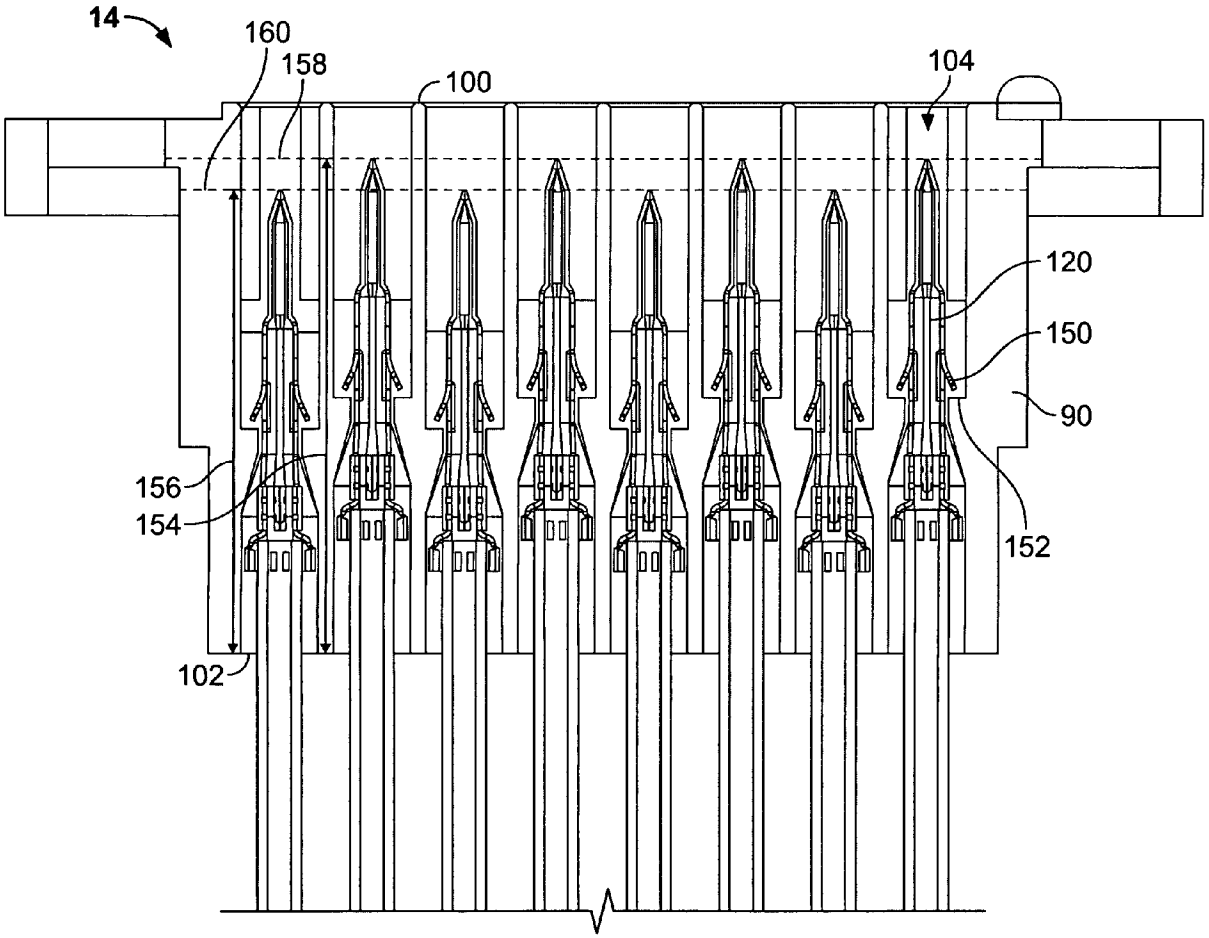
FIG. 3 is a cross sectional view of a plug connector of the connector assembly shown in FIG. 1.

FIG. 3 is a cross sectional view of the plug assembly 14. The contacts 120 are received within the contact cavities 104. In the illustrated embodiment, the contacts 120 are held within the contact cavities 104 by barbs or lances 150 extending outward that engage shoulders 152 formed within the contact cavities 104. The shoulders 152 resist removal of the contacts 120 from the contact cavities 104. Optionally, the positioning of the shoulders 152 with respect to the contact loading end 102 of the housing 90 may be staggered for adjacent contact cavities 104. As a result, the positioning of the contacts 120 within the housing 90 may be staggered. When assembled, the contacts 120 are arranged in a first group of contacts 120 positioned at a first depth 154 from the contact loading end 102 and a second group of contacts 120 positioned at a second depth 156 from the contact loading end 102. As a result, the mating ends 122 of the contacts 120 in the first group are aligned along a first plane 158 and the mating ends 122 of the contacts in the second group are aligned along a second plane 160. The first and second planes 158 and 160, respectively, are parallel to one another and are parallel to the mating end 100 of the housing 90.

When mated with the receptacle connector 12 (shown in FIG. 1), the receptacle contacts 60 (shown in FIG. 1) engage the contacts 120 in the first group prior to engaging the contacts 120 in the second group.

A connector assembly 10 is thus provided in a cost effective and reliable manner. The connector assembly 10 includes a receptacle connector 12 and a plug connector 14. The receptacle connector 12 and the plug connector 14 each include blind mating members that orient and align the connectors for mating, and the receptacle connector 12 and the plug connector 14 each include locking members that lockably engage one another. The plug connector 14 includes contacts 120 that are staggered in a first group that is at a first depth and a second group that is at a second depth. As a result, the mating forces of the connectors is reduced.

While the invention has been described in terms of various specific embodiments, those skilled in the art will recognize that the invention can be practiced with modification within the spirit and scope of the claims.

What is claimed is:

1. A connector comprising:

a housing with a plurality of contact cavities arranged in a matrix having M columns and N rows of contact cavities, each of the contact cavities extending between a contact loading side and a mating side of the housing configured to interface with a mating connector, and each of the contact cavities being defined by cavity walls extending between the contact loading side and the mating side; and contacts received within respective ones of the contact cavities, the contacts being surrounded by the walls such that adjacent ones of the contacts are separated from one another along a length of the contacts by the cavity walls, wherein a first group of the contacts are held within the contact cavities at a first depth with respect to the contact loading side and a second group of the contacts are held within the contact cavities at a different second depth with respect to the contact loading side, wherein the first group of contacts are located in odd numbered columns of the contact cavities and the second group of contacts are located in even numbered columns of the contact cavities.

2. The connector in accordance with claim 1, wherein the housing includes a locking member extending from the mating side for locking engagement with the mating connector.

3. The connector in accordance with claim 1, wherein the housing includes a blind mating member extending from the mating side for orienting the housing with respect to the mating connector.

4. The connector in accordance with claim 1, wherein the contacts in the first group are alternately staggered with respect to the immediately adjacent contacts in the second group within at least one of a common row and a common column.

5. The connector in accordance with claim 1, wherein each contact has a mating end, the mating end of each contact in the first group being arranged along a first plane, the mating end of each contact in the second group being arranged along a second plane parallel to the first plane and parallel to the mating side of the housing.

6. The connector in accordance with claim 1, wherein a first set of the contact cavities have a first shape and a second set of the contact cavities have a second shape, the contact cavities being arranged in a pattern to form a keyed mating pattern of the housing with a mating connector.

7. The connector in accordance with claim 1, wherein the connector comprises a cable connector configured to be joined to a cable and the mating connector comprises a mating cable connector configured to be joined to a different cable.

8. The connector in accordance with claim 1, wherein the connector comprises one of a plug and a receptacle.

9. A connector assembly comprising:

a receptacle connector comprising a receptacle housing with a plurality of receptacle contact cavities arranged in a matrix and extending between a contact loading side and a mating side of the receptacle housing, and the receptacle connector further comprising receptacle contacts held within respective ones of the receptacle contact cavities; and a plug connector comprising a plug housing with a plurality of plug contact cavities arranged in a matrix that complements the matrix of receptacle contact cavities, each of the plug contact cavities extending between a contact loading side and a mating side of the plug housing, the plug connector further comprising plug contacts received within respective ones of the plug contact cavities, wherein a first group of the plug contacts are held within the plug contact cavities at a first depth with respect to the contact loading side of the plug connector and a second group of the plug contacts are held within the plug contact cavities at a different second depth with respect to the contact loading side of the plug connector, wherein the plug contacts in the first group are alternately staggered with respect to the immediately adjacent plug contacts in the second group within at least one of a common row and a common column, and wherein the receptacle contacts engage the plug contacts arranged at the first depth prior to engaging the plug contacts at the second depth during mating of the receptacle connector with the plug connector.

10. The connector assembly in accordance with claim 9, wherein the receptacle housing includes a locking member extending from an outer surface of the receptacle housing proximate the mating side, and wherein the plug housing includes a locking member extending from the mating side for locking engagement with the locking member of the receptacle connector.

11. The connector assembly in accordance with claim 9, wherein the receptacle housing includes a blind mating member extending from an outer surface of the receptacle housing proximate the mating side, and wherein the plug housing includes a blind mating member extending from the mating side for keying engagement with the blind mating member of the receptacle connector.

12. The connector assembly in accordance with claim 9, wherein the matrix includes M columns and N rows of plug contact cavities, the first group of plug contacts are located in the odd numbered columns of the plug contact cavities and the second group of plug contacts are located in even numbered columns of the plug contact cavities.

13. The connector assembly in accordance with claim 9, wherein each of the plug contacts has a mating end, the mating end of each plug contact in the first group being arranged along a first plane, the mating end of each plug contact in the second group being arranged along a second different plane parallel to the first plane and parallel to the mating side of the plug housing.

14. The connector assembly in accordance with claim 9, wherein for each of the receptacle connector and the plug connector, a first set of the contact cavities have a first shape and a second set contact cavities have a second shape, the contact cavities being arranged in a pattern to form a keyed mating pattern for mating the receptacle connector and the plug connector.

15. The connector assembly in accordance with claim 9, wherein the receptacle contacts are joined to a cable and the plug contacts are joined to a cable.

16. The connector assembly in accordance with claim 9, wherein the receptacle connector further comprises a positive locking member received in the receptacle housing and exposed within a plurality of the receptacle contact cavities, wherein the positive locking member engages the receptacle contacts to resist removal of the receptacle contacts from the receptacle contact cavities.

17. The connector assembly in accordance with claim 9, wherein the receptacle connector further comprises a positive locking member having a plurality of arms, each arm engaging contacts in a respective row of the receptacle contact cavities.

18. A connector assembly comprising:

a receptacle connector comprising a receptacle housing with a plurality of receptacle contact cavities arranged in a matrix and extending between a contact loading side and a mating side of the receptacle housing, and the receptacle connector further comprising receptacle contacts held within respective ones of the receptacle contact cavities, wherein the receptacle connector comprises a first positive locking member and a second positive locking member, the first and second positive locking members received in opposing sides of the receptacle housing, the first and second positive locking members each having an overlap section that overlaps with one another within the receptacle housing; and a plug connector comprising a plug housing with a plurality of plug contact cavities arranged in a matrix that complements the matrix of receptacle contact cavities, each of the plug contact cavities extending between a contact loading side and a mating side of the plug housing, the plug connector further comprising plug contacts received within respective ones of the plug contact cavities, wherein a first group of the plug contacts are held within the plug contact cavities at a first depth with respect to the contact loading side of the plug connector and a second group of the plug contacts are held within the plug contact cavities at a different second depth with respect to the contact loading side of the plug connector, wherein the receptacle contacts engage the plug contacts arranged at the first depth prior to engaging the plug contacts at the second depth during mating of the receptacle connector with the plug connector.

19. The connector assembly in accordance with claim 18, wherein the first group of contacts are located in odd numbered columns of the contact cavities and the second group of contacts are located in even numbered columns of the contact cavities.

20. The connector assembly in accordance with claim 18, wherein the plug contacts in the first group are alternately staggered with respect to the immediately adjacent plug contacts in the second group within at least one of a common row and a common column.

* * * * *